United States Patent [19]

Jones

[11] Patent Number: 4,576,575

[45] Date of Patent: Mar. 18, 1986

[54] SLIP JOINT TOOLING FIXTURE FOR AIRFRAME STRUCTURE AND THE LIKE

[75] Inventor: Everett E. Jones, Wichita, Kans.

[73] Assignee: The Boeing Company, Seattle, Wash.

[21] Appl. No.: 740,563

[22] Filed: Jun. 3, 1985

[51] Int. Cl.[4] ..... F27D 5/00; F27D 1/00

[52] U.S. Cl. ..... 432/253; 432/251

[58] Field of Search ..... 432/253, 251; 100/93 P; 249/82; 425/DIG. 29, 407

[56] References Cited

U.S. PATENT DOCUMENTS 2,271,599 2/1942 Maurer ..... 100/93 P 2,483,957 10/1949 Wright ..... 269/104 X 4,449,703 5/1984 Robinson ..... 269/71

*Primary Examiner*—John J. Camby

*Attorney, Agent, or Firm*—Edwin H. Crabtree

[57] ABSTRACT

A slip joint tooling fixture for providing unrestricted growth of material used in an airframe structure when heated under high temperatures. The fixture while allowing the unrestricted growth of the material also maintains the overall configuration and integrity of the structure being built. The fixture further provides for minimum restriction of airflow around the outer surface of the structure during the heating up and cooling down process.

7 Claims, 7 Drawing Figures

SLIP JOINT TOOLING FIXTURE FOR AIRFRAME STRUCTURE AND THE LIKE

BACKGROUND OF THE INVENTION

This invention relates to a tooling fixture and more particularly a slip joint tooling fixture used for forming various types of airframe structures and other structures under high temperatures when received in an oven or other heating device.

Heretofore, with the introduction of graphite and thermoplastic impregnated materials for airframe structures a need has arisen for a fixture that will provide an accurate configuration when working in an environment up to and greater than 800° fahrenheit.

Heretofore, conventional egg crate welded structures have proven unsatisfactory. These type structures are rigid in structure and the nature of their design presents conditions for uneven temperatures throughout the fixture, which produces distortions generated by different expansion ratios during the periods of heating up and cooling down. These distortions destroy the overall integrity of the material under construction and its finished design.

In the following United States patents; U.S. Pat. No. 2,483,957 to Wright, U.S. Pat. No. 2,490,111 to Whitehead, U.S. Pat. No. 2,786,434 to Klungtvedt, U.S. Pat. No. 2,887,974 to Weinfeld, U.S. Pat. No. 2,920,422 to Freiberg, U.S. Pat. No. 3,301,547 to Jordan, U.S. Pat. No. 3,716,225 to Percich and U.S. Pat. No. 4,449,703 to Robinson various types of tool fixtures, welding guides, welding holders and multiple supports are shown. None of these devices provide the unique features and advantages for providing accurate control of the configuration of a structure formed in a tooling fixture such as the subject invention.

SUMMARY OF THE INVENTION

The subject tooling fixture provides for unrestricted growth of the structure's material while maintaining the configuration integrity of the structure being formed.

The tooling fixture also is designed to provide minimum restriction of airflow around the outer surface of the fixture so that the interior and outer surfaces are provided with a more uniform heat-up and cool-down of the fixture and the structure under construction.

The slip joint tooling fixture for providing unrestricted growth of a material used for forming an airframe structure or the like includes an upper frame and a lower frame having a plurality of spaced apart bulk heads having rollers mounted thereon for engaging an upper and lower caul plate. The two plates receive the structure to be formed therebetween. One end of the caul plates is secured while the opposite end of the plates is allowed to expand and contract during the heating up and cooling down of the fixture. The upper frame and the lower frame with bulk heads are joined together by floating connectors which allow for vertical adjustment and lateral or horizontal adjustment of the frames and bulk heads with caul plates.

The advantages and objects of the invention will become evident from the following detailed description of the drawings when read in connection with the accompanying drawings which illustrate preferred embodiments of the invention.

BRIEF DESCRIPTION OF THE DRAWINGS

FIGS. 5 and 6 illustrate an enlarged side view of the bulk heads with rollers and the upper and lower caul plates attached at opposite ends to the bulk heads.

DETAILED DESCRIPTION OF THE DRAWINGS

Figure 1:
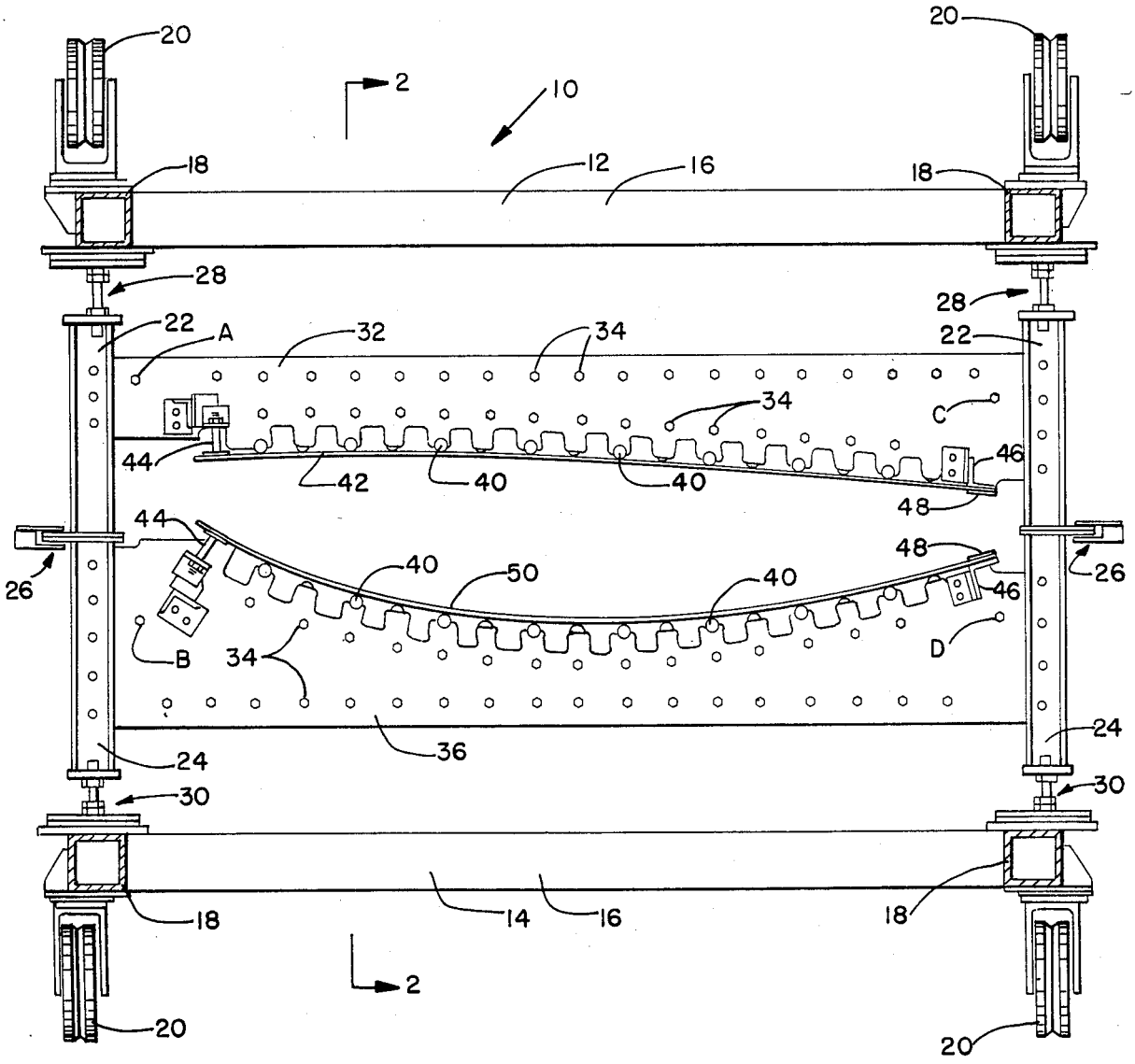
In FIG. 1 a front view of the slip joint tooling fixture is illustrated.
Figure 2:
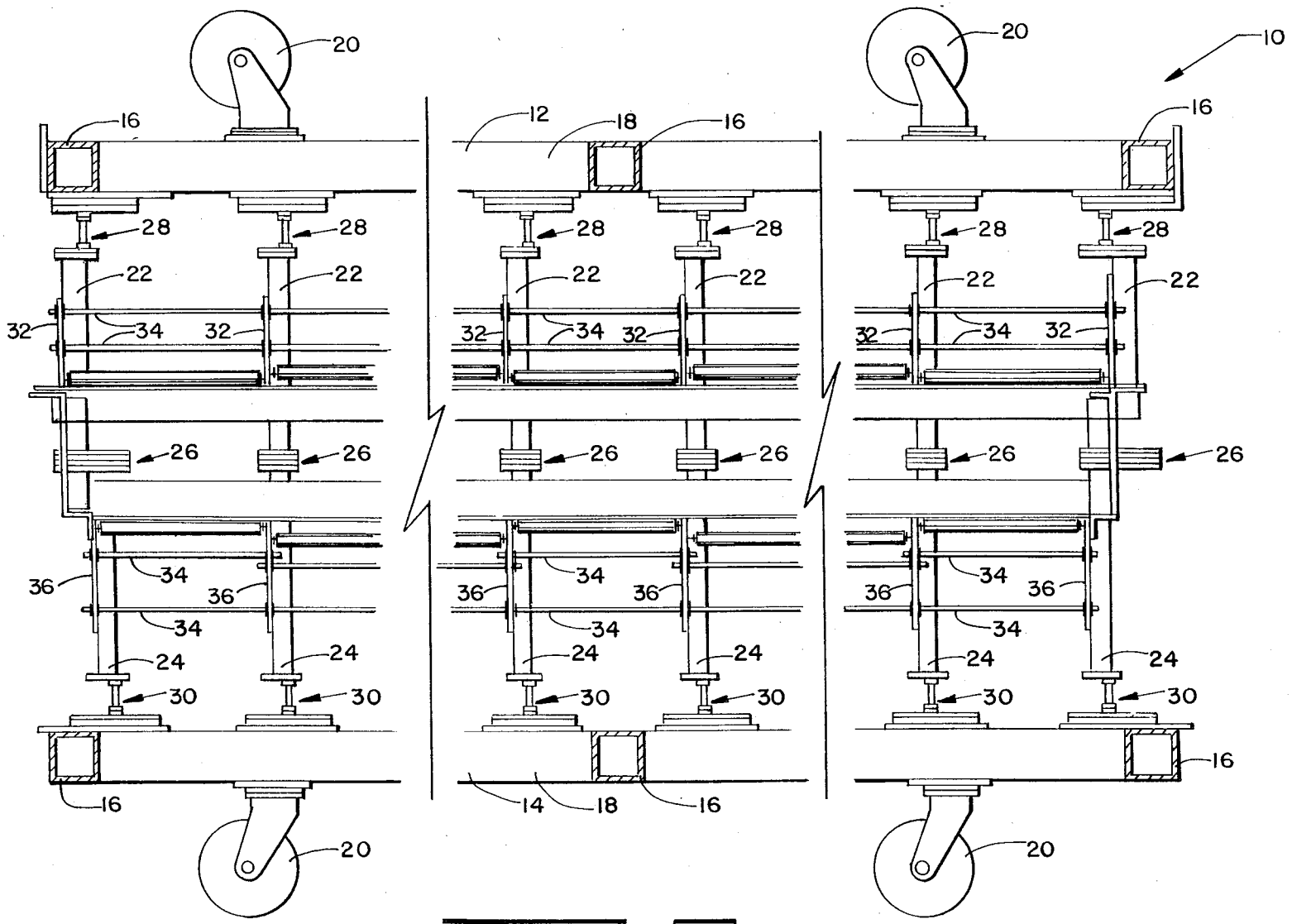
FIG. 2 illustrates a side view of the fixture.

In FIG. 1 and FIG. 2 taken along lines 2—2 shown in FIG. 1 the slip joint tooling fixture is shown and designated by general reference numeral 10. The fixture 10 includes an upper horizontal frame 12 and a lower horizontal frame 14. The frames include cross-members 16 connected to side members 18 along the length of the fixture 10. Each of the frames 12 and 14 include castor wheels 20 for transporting the fixture 10. The castor wheels 20 shown on top of the frame 12 would be used when the two frames are disassembled from each other.

The upper frame 12 is connected to a plurality of vertical upper bulk head supports 22 and the lower frame 14 is connected to a plurality of vertical lower bulk head supports 24. The bulk head supports 22 and 24 are joined together by vertical and lateral adjustment connectors designated by general reference numeral 26 and shown in detail in FIG. 3. The two frames 12 and 14 are connected to the bulk head supports 22 and 24 by a plurality of upper floating connectors designated by general reference numeral 28 and lower floating connectors designated by general reference numeral 30. The upper and lower connectors are the same. These connectors are shown in detail in FIG. 4.

The upper bulk head supports 22 are used to hold a plurality of bulk heads 32 in a vertical spaced relationship to each other. The bulk heads 32 are secured to each other by threaded rods 34 shown in FIG. 2. Also, lower bulk heads 36 are attached at opposite ends to the lower bulk head supports 24 and held in a spaced relationship to each other by the threaded rods 34.

Referring to FIG. 1 along the length of the lower portion of the upper bulk heads 32 and along the length of the upper portion of the lower bulk heads 36 are a plurality of roller arms 38 having rollers 40 mounted on the ends of the arms.

An upper caul plate 42 is attached at one end to the upper bulk heads 32 by a threaded adjustment screw 44 which is stud welded to the end of the caul plate 42. The other end of the caul plate 42 is slidably received into a pair of expansion lips 46 and 48 attached to the other side of the upper bulk heads 32. A lower caul plate 50 is received against the lower rollers 40 on the lower bulk heads 36 with one end attached to a threaded screw 44. The other end of the plate 50 is also received in a pair of retaining lips 46 and 48 attached to the sides of the lower bulk heads 36.

From reviewing FIG. 1 and FIG. 2 the caul plates 42 and 50 are formed into a configuration for forming an aircraft wing structure made up of graphite composite material and thermoplastic impregnated material such as Peek. These materials are shown in greater detail in FIG. 7. While the aircraft wing structure and its configuration is shown in the drawings, it should be kept in mind that the tooling fixture 10 can be used for various types of structures used in the aircraft industry or other industries where the fixture 10 is subject to temperatures up to 800° and greater in ovens or other heating devices.

Figure 3:
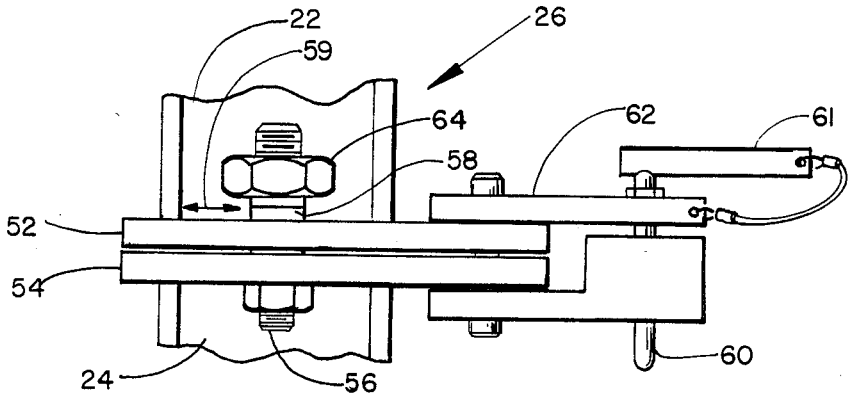
FIG. 3 illustrates a side view of the vertical adjustment assembly and connector for joining together the upper and lower frames.

In FIG. 3 an enlarged side view of the bulk head support vertical and lateral adjustment connectors 26 are shown. A lower flange 52 is attached to the bottom of the upper bulk head support 22 with an upper flange 54 attached to the top of the lower bulk head support 24. The two flanges are joined together by a threaded screws 56 with an aperture 58 being oversized in the lower flange 52 to allow for lateral movement indicated by arrow 59 provided by an adjusting lever pin 60 with handle 61 attached to a lever arm 62 and pinned to the flange 52. The pin 60 is also connected to a lower arm 63 pinned to the flange 54. By moving the lateral alignment pin 60, proper adjustments may be made between tooling points shown in point A, point B, point C and point D in FIG. 1. Also, by the use of an adjustment nut 64 received around the threaded screw 56, vertical adjustments may be made on the connectors 26 for proper vertical adjustment between points A and C on the upper bulk heads 32 and points B and D on the lower bulk heads 36. The distances between the four points are known and prior to the heating up of the fixture 10 the necessary corrections of distance can be made by adjusting each of the connectors 26.

Figure 4:
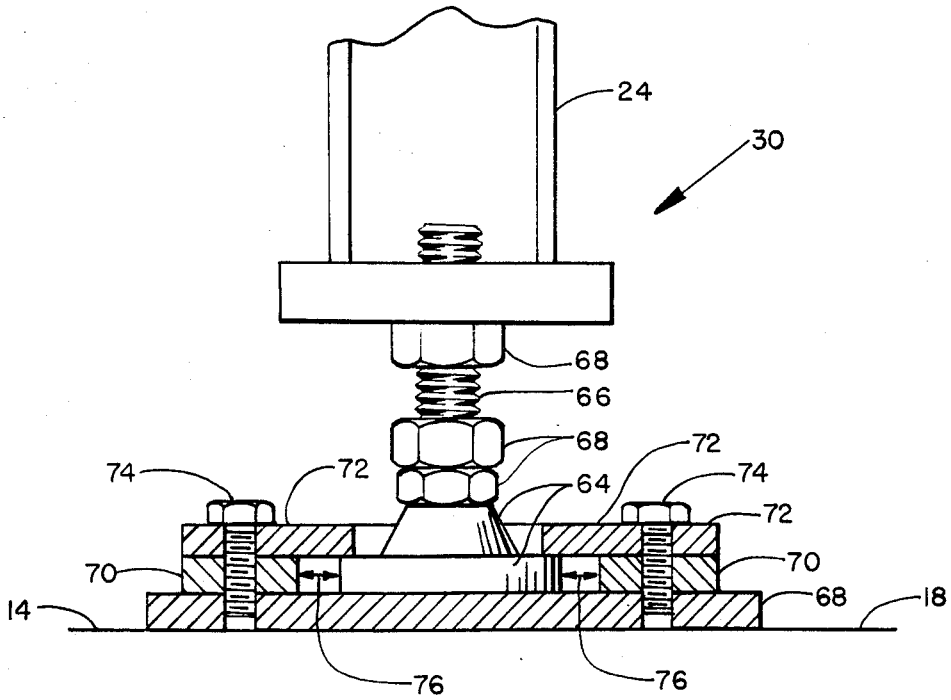
FIG. 4 illustrates a side sectional view of the leveling foot assembly.

In FIG. 4 an enlarged side section view of the floating connectors 30 is shown. Each of the connectors 30 include a floating pad 64 having an outwardly extending threaded screw 66 having lock nuts 68 for securing the connector 30 to the bulk head supports 22 and 24. The floating pad 64 is received on top of a bearing surface 68 attached to either the top or bottom of the frames 12 and 14. Disposed around the pad 64 is a pad housing 70 and a retainer ring 72 held thereon by a pair of bolts 74. Sufficient space 76 is provided around the periphery of the floating pad 64 and inside the pad housing 70 to allow the floating pad 64 to move laterally or in a horizontal plane as the bulk heads and bulk head supports are subjected to heating up and cooling down of the fixture 10.

Figure 5:
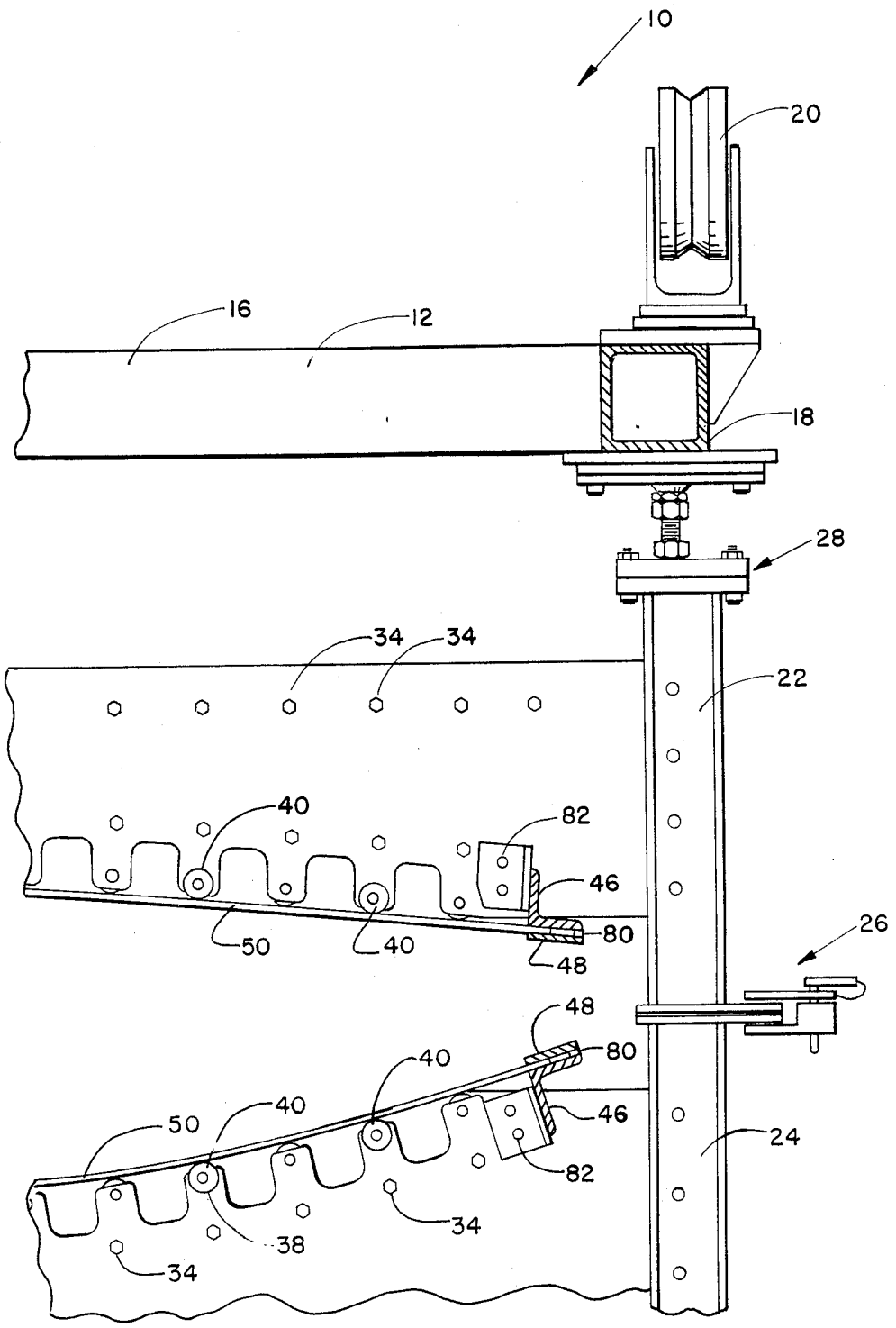
Figure 5:
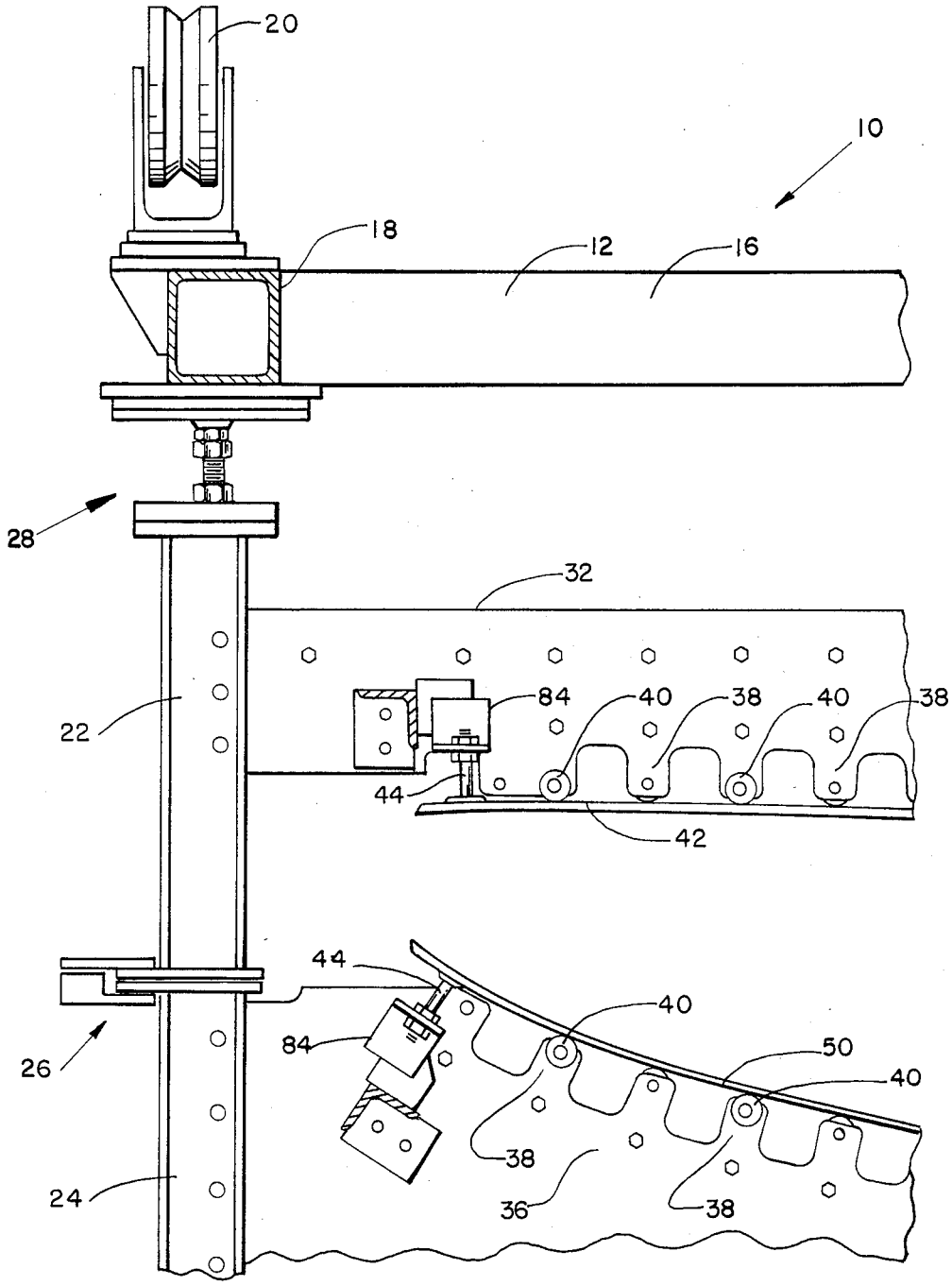

In FIG. 5 an enlarged side sectional view of the upper bulk head 32 and lower bulk head 36 are shown. In this Fig. a portion of the upper caul plate 42 and lower caul plate 50 can be seen with their opposite end portions of the plates received between the retaining lips 46 and 48 with a space 80 provided which is sufficient in length to provide for freedom of the lengthening and shortening of the caul plates which is due to the temperature differentials between the bulk heads and caul plate surfaces. The movement of the caul plates occuring during heat-up and cool-down of the fixture 10. The retaining lips 46 and 48 are held against the side of the bulk heads by attachment supports 82.

In FIG. 6 an opposite end of the caul plates 42 and 50 are shown with adjustment screws 44 threadably secured to screw supports 84 attached to the sides of the upper and lower bulk heads 32 and 36. Seen in both FIG. 5 and FIG. 6 is an enlarged view of the rollers 40 and roller arms 38 shown with each adjacent roller mounted on opposite sides of the roller arms 38. The rollers provide a bearing surface for the caul plates 42 and 50 when the structure is formed therebetween.

Figure 7:
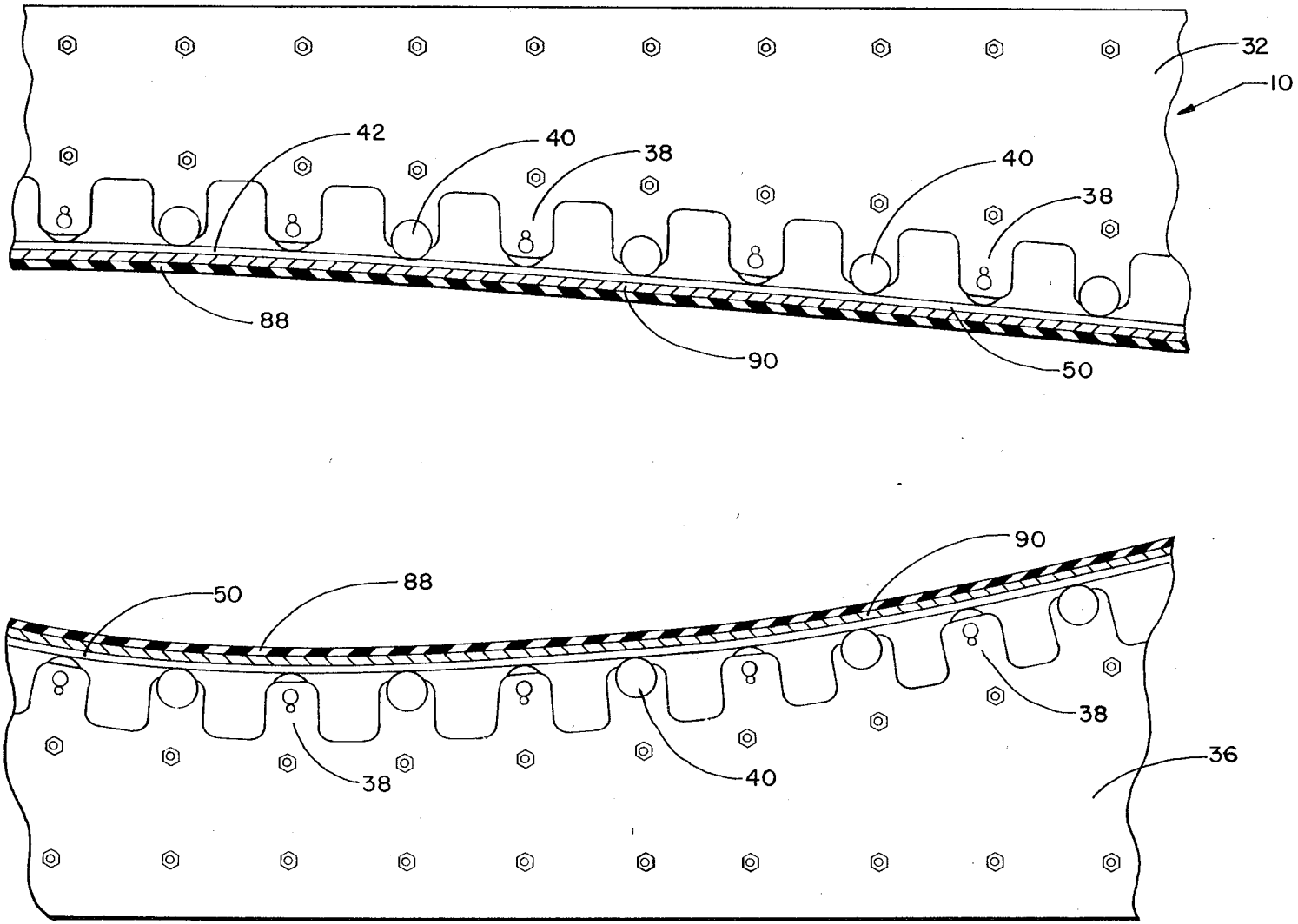
FIG. 7 illustrates a side view of a portion of the airframe structure formed between the upper and lower caul plates.

In FIG. 7 a vacuum bag 86 is received between the caul plates 42 and 50 with a bleeder blanket 88 received against a structure 80 being formed as mentioned above of either graphite composites, thermoplastic materials or a combination of both or any other types of synthetic materials used in making the structure and formed under high temperatures. It should be noted that insulation is provided by the material 90 and the bleeder blanket 88 which generates a temperature differential on opposite sides of the caul plates 42 and 50. The temperature differential, in turn, causes the outer surface of the caul plates 42 and 50 to expand under the heat applied thereby bowing outwardly the caul plates against the rollers 40. The rollers 40 act as spline points, thereby keeping the integrity of the structures configuration with the necessary movement provided through the retainer lips and the floating connectors and securing the bulk head supports to the frames of the fixture 10.

From reviewing the above drawings it can be seen that the fixture 10 provides for minimum restriction of airflow around the outer surface of the fixture structure for producing a uniform heat up and cool down of the fixture and the material 90 used in making a desired structure.

Changes may be made in the construction and arrangment of the parts or elements of the embodiments as described herein without departing from the spirit or scope of the invention defined in the following claims.

What is claimed is:

1. A slip joint tooling fixture for providing unrestricted growth of material of a structure under construction and received in the fixture, the fixture and structure subjected to high temperatures, the fixture comprising:

an upper horizontal frame;

a plurality of upper bulk heads disposed vertically and in a spaced relationship to each other with the opposite ends of the bulk heads attached to bulk head supports;

a plurality of upper floating connectors attaching the upper bulk head supports to the upper frame;

a plurality of rollers attached to roller arms integrally formed along the length of the upper bulk heads for receiving the upper caul plate, one end of the caul plate attached on one side of the bulk heads, the other end of the caul plate slidably received in an expansion means attached on the other side of the bulk heads for allowing the caul plate to expand and contract therein;

a lower horizontal frame;

a plurality of lower bulk heads disposed vertically and in a spaced relationship to each other with the opposite ends of the bulk heads attached to lower bulk head supports;

a plurality of lower floating connectors attaching the lower bulk head supports to the lower frame;

a plurality of rollers attached to roller arms integrally formed along the length of the lower bulk heads for receiving a lower caul plate, one end of the caul plate attached on one side of the bulk heads, the other end slidably received in an expansion means attached on the other side of the bulk heads for allowing the caul plate to expand and contract; and attachment means for securing together the upper and lower bulk head supports.

2. The fixture as described in claim 1 further including a plurality of threaded rods disposed along the length of the fixture and connecting together a plurality of the upper and lower bulk heads and holding the bulk heads in a spaced relationship to each other.

3. The fixture as described in claim 1 wherein the upper and lower frame include castor wheels attached thereto for transporting the fixture.

4. The fixture as described in claim 1 wherein the upper bulk head supports are connected to the lower bulk head supports by vertical and lateral adjustment connectors for providing vertical adjustment of the upper bulk heads in relationship to the lower bulk heads and lateral or horizontal adjustment of the bulk heads.

5. The fixture as described in claim 1 wherein the means for expansion of the upper and lower caul plates on one side of the bulk heads is a pair of retaining lips attached to the sides of the bulk heads and having sufficient space therebetween for receiving the end of the caul plates and allowing the plates to expand and contract therein.

6. The fixture as described in claim 1 wherein the upper and lower floating connectors include a floating pad with threaded adjustment screw extending upwardly therefrom, the adjustment screw threadably attached to the bottom of the upper bulk head supports and the top of the lower bulk head supports with the floating pad secured in a pad housing and against a bearing surface on the bottom of the upper frame and the top of the lower frame for allowing the bulk heads to move in a horizontal plane when the fixture is heated and cooled.

7. A slip joint tooling fixture for providing unrestricted growth of material of a structure under construction and received in the fixture, the fixture and structure subjected to high temperatures, the fixture comprising:

an upper horizontal frame having side members and cross-members making up the frame;

a plurality of upper bulk heads disposed vertically and in a spaced relationship to each other with the opposite ends attached to upper bulk head supports;

a plurality of upper floating connectors connected to the bottom of the upper frame and to the top of the upper bulk head supports, the connectors allowing the upper bulk heads to move in a horizontal plane;

a plurality of rollers attached to roller arms integrally formed along the length of the bulk heads for receiving an upper caul plate, one end of the caul plate attached on one side of the bulk heads, the other end slidably received in an expansion means attached to the other side of the bulkheads for allowing the caul plate to expand and contract therein;

a horizontal lower frame having side members and cross members making up the frame;

a plurality of lower bulk heads disposed vertically and in spaced relationship to each other with the opposite ends of the bulk heads attached to lower bulk head supports;

a plurality of lower floating connectors connected to the top of the lower frame and to the bottom of the lower bulk head supports, the connectors allowing the lower bulk heads to move in a horizontal plane;

a plurality of rollers attached to roller arms integrally formed along the length of the bulk heads for receiving a lower caul plate, one end of the caul plate attached on one side to the bulk heads, the other end slidably received in an expansion means attached to the other side of the bulk heads for allowing the caul plate to expand and contract therein; and attachment means for securing together with the upper bulk head supports and the lower bulk head supports.

* * * * *